US007889049B2

(12) United States Patent
Ito

(10) Patent No.: US 7,889,049 B2
(45) Date of Patent: Feb. 15, 2011

(54) ELECTRONIC COMPONENT

(75) Inventor: Hiromasa Ito, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 110 days.

(21) Appl. No.: 12/484,290

(22) Filed: Jun. 15, 2009

(65) Prior Publication Data

US 2009/0309691 A1 Dec. 17, 2009

(30) Foreign Application Priority Data

Jun. 16, 2008 (JP) ..... 2008-156083

(51) Int. Cl.
*H01C 13/00* (2006.01)

(52) U.S. Cl. ..... 338/220; 338/307; 338/22 R

(58) Field of Classification Search ..... 338/220, 338/22 R, 307–309
See application file for complete search history.

(56) References Cited

U.S. PATENT DOCUMENTS 5,347,423 A * 9/1994 deNeuf et al. ..... 361/313
5,994,995 A * 11/1999 Ogasawara et al. ..... 338/21

FOREIGN PATENT DOCUMENTS

JP 05-243007 A 9/1993
JP 06-053008 A 2/1994
JP 10-135007 A 5/1998
JP 11-102803 A 4/1999

OTHER PUBLICATIONS

Official Communication issued in corresponding European Patent Application No. 09251572.5, mailed on Oct. 21, 2009.

* cited by examiner

*Primary Examiner*—Kyung Lee
(74) *Attorney, Agent, or Firm*—Keating & Bennett, LLP

(57) ABSTRACT

An electronic component includes a layered structure, an isolated electrode, first and second external electrodes, and first and second internal electrodes. The layered structure includes laminated ceramic layers laminated. The first and second external electrodes are disposed on the surface of the layered structure. The isolated electrode extends in the x-axis direction inside the layered structure and is not connected to the first and second external electrodes. The first internal electrode faces a first end of the isolated electrode with a ceramic layer therebetween. The second internal electrode faces a second end of the isolated electrode with a ceramic layer therebetween. When viewed in plan from the z-axis direction, the width of the isolated electrode in the y-axis direction decreases in the direction from the first end to the second end of the isolated electrode.

5 Claims, 10 Drawing Sheets

ELECTRONIC COMPONENT

BACKGROUND OF THE INVENTION

1. Field of the Invention

The present invention relates to electronic components, and an electronic component that includes a thermistor.

2. Description of the Related Art

A known example of a traditional electronic component that includes a thermistor is a laminated thermistor described in Japanese Unexamined Patent Application Publication No. 5-243007.

FIGS. 10A and 10B illustrate a laminated thermistor 110. FIG. 10A illustrates the laminated thermistor 110 viewed from the lamination direction (z-axis direction), and FIG. 10B is a cross-sectional view of the laminated thermistor 110 in an xy plane. The laminated thermistor 110 includes an internal electrode 106*a* connected to an external electrode 114*a*, an internal electrode 106*b* connected to an external electrode 114*b*, and an internal electrode 107 overlapping the internal electrodes 106*a* and 106*b*.

An electronic component that includes a thermistor is used in various devices, such as a cellular phone, a personal computer, or a power supply component, for example. To support various uses, it is preferable for such an electronic component including a thermistor to allow variations in the resistance value of the thermistor to be increased without a significant change of thermistor characteristics, such as a rate of change of resistance or breakdown voltage. That is, an electronic component is desired that allows the resistance value to be easily and precisely adjusted without a significant change of the structure among thermistors in which various resistance values are required.

However, it is difficult for the laminated thermistor 110 described in Japanese Unexamined Patent Application Publication No. 5-243007 to allow the resistance value to be changed without a significant change in the structure for the reasons described below. The resistance value in the laminated thermistor 110 depends on the sum of the area S11 of the region E11 where the internal electrode 106*a* and the internal electrode 107 overlap each other and the area S12 of the region E12 where the internal electrode 106*b* and the internal electrode 107 overlap each other. One possible approach to adjusting the resistance value in the laminated thermistor 110 is to change the sum of the areas S11 and S12 of the two regions E11 and E12.

However, in the laminated thermistor 110, because, even if the internal electrode 107 is displaced in the x-axis direction and the area S11 of the region E11 where the internal electrode 106*a* and the internal electrode 107 overlap each other is increased, the area S12 of the region E12 where the internal electrode 106*b* and the internal electrode 107 overlap each other is decreased, the sum of the two areas S11 and S12 is constant. Accordingly, in order to change the resistance value in the laminated thermistor 110, it is necessary to change the design, for example, the size or shape of the internal electrodes 106*a*, 106*b*, and 107 for each of various thermistors. In other words, for the laminated thermistor 110 described in Japanese Unexamined Patent Application Publication No. 5-243007, it is difficult to easily change the resistance value without having to significantly change the structure. With a method of changing the shape of the internal electrodes 106*a*, 106*b*, and 107 for each desired resistance value, it is difficult to make fine adjustments such that the resistance value is in a desired range.

SUMMARY OF THE INVENTION

To overcome the problems described above, preferred embodiments of the present invention provide an electronic component in which the resistance value can be changed without a significant change in the basic structure thereof, and in particular, fine adjustment to the resistance value can be made.

According to a preferred embodiment of the present invention, an electronic component includes a layered structure, a first external electrode and a second external electrode, an isolated electrode, a first internal electrode, and a second internal electrode. The layered structure includes laminated ceramic layers. The first external electrode and a second external electrode are disposed on a surface of the layered structure. The isolated electrode extends in a predetermined direction inside the layered structure and is not connected to the first external electrode and the second external electrode. The first internal electrode is connected to the first external electrode. The first internal electrode faces a first end of the isolated electrode such that one of the ceramic layers is disposed therebetween. The second internal electrode is connected to the second external electrode. The second internal electrode faces a second end of the isolated electrode such that one of the ceramic layers is disposed therebetween. When viewed in plan from a direction in which the ceramic layers are laminated, the isolated electrode includes a non-overlapping portion including a first section having a first width between opposite ends thereof and a second section having a second width between opposite ends thereof, and the first width is greater than the second width, the non-overlapping portion not overlapping the first internal electrode and the second internal electrode, the first section being in contact with at least one of the first internal electrode and the second internal electrode, the second section being in contact with the other one of the first internal electrode and the second internal electrode, the first width and the second width being substantially perpendicular to the predetermined direction.

With this electronic component, the first width is greater than the second width. Thus, in the electronic component, when the isolated electrode is moved in the predetermined direction, the amount of increase or decrease in the area of the overlapping portion between the first internal electrode and the isolated electrode is greater than the amount of increase or decrease in the area of the overlapping portion between the second internal electrode and the isolated electrode. Accordingly, the sum of the area of the overlapping portion between the first internal electrode and the isolated electrode and the area of the overlapping portion between the second internal electrode and the isolated electrode can be increased or decreased, and the resistance value of the electronic component can be decreased or increased accordingly. As a result, fine adjustment of the resistance value can preferably be performed merely by moving the isolated electrode without having to change the design of the isolated electrode, for example, the size or shape thereof.

The first width may preferably be greater than the second width even when the isolated electrode is moved in the predetermined direction.

The isolated electrode may preferably have a width arranged substantially perpendicular to the predetermined direction which decreases in a direction from the first end to the second end thereof, and each of the first internal electrode and the second internal electrode may preferably have a width arranged substantially perpendicular to the predetermined direction and being equal or substantially equal to or greater than each of the width of the isolated electrode at the first end and the width of the isolated electrode at the second end.

The width of the isolated electrode arranged substantially perpendicular to the predetermined direction preferably decreases in the direction from the first end to the second end of the isolated electrode. Thus, irrespective of the amount of movement of the isolated electrode, the first width is always greater than the second width. As a result, the range of the adjustment of the resistance value can be increased by an increase in the amount of movement of the isolated electrode. In addition, each of the width of the first internal electrode and the width of the second internal electrode arranged substantially perpendicular to the predetermined direction are equal or substantially equal to or greater than each of the width of the isolated electrode at the first end and that at the second end. Accordingly, in the process of forming the layered structure in the electronic component, even if the isolated electrode is displaced in a direction substantially perpendicular to the predetermined direction due to misregistration during lamination of the ceramic green sheets, the isolated electrode is less likely to extend from the first and second internal electrodes. As a result, deviations in the resistance value of the electronic component are prevented.

The isolated electrode may preferably include a space that has no conductive film, and the space may preferably have a width arranged substantially perpendicular to the predetermined direction that increases in a direction from the first end to the second end of the isolated electrode. Therefore, the outer shape of the isolated electrode can preferably remain substantially rectangular, so as to prevent deviations in the resistance value.

Each of the isolated electrode, the first internal electrode, and the second internal electrode may preferably have a width arranged substantially perpendicular to the predetermined direction and increasing a direction from the first end to the second end of the isolated electrode. The isolated electrode, the first internal electrode, and the second internal electrode may preferably have substantially the same electrode pattern. Therefore, the isolated electrode, the first internal electrode, and the second internal electrode can be formed using one electrode pattern. Therefore, the manufacturing efficiency of the electronic component is improved.

With the electronic component according to various preferred embodiments of the present invention, when viewed in plan from the lamination direction, the first width at opposite ends of the first section of the non-overlapping portion of the isolated electrode which does not overlap the first internal electrode and the second internal electrode in contact with the first internal electrode is greater than the second width at opposite ends of the second section of the non-overlapping portion of the isolated electrode in contact with the second internal electrode. Accordingly, the resistance value can be changed without a significant change of the structure of the electronic component. In particular, the resistance value can be minutely adjusted or changed. Therefore, variations in the resistance value that are slightly different can be increased without a significant change in the thermistor characteristics.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

An electronic component according to preferred embodiments of the present invention is described below. The electronic component is a laminated electronic component that includes a negative temperature coefficient (NTC) thermistor.

Figure 1:
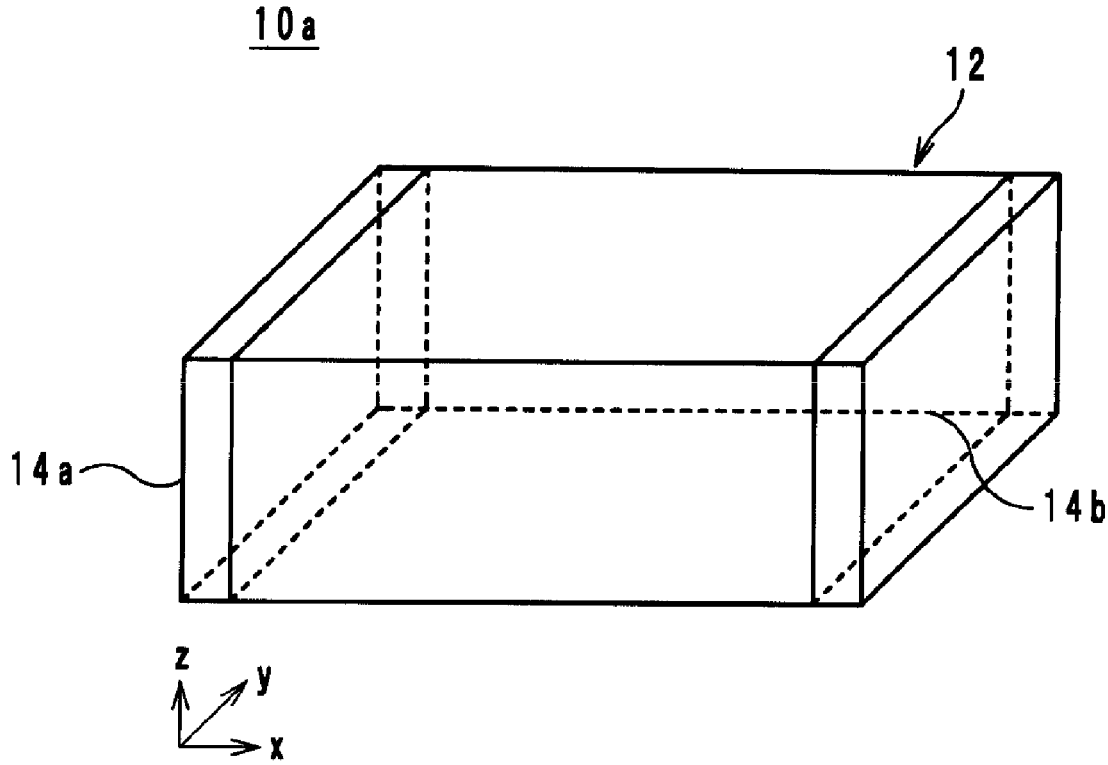
FIG. 1 is an external perspective view of an electronic component according to a preferred embodiment of the present invention.
Figure 2:
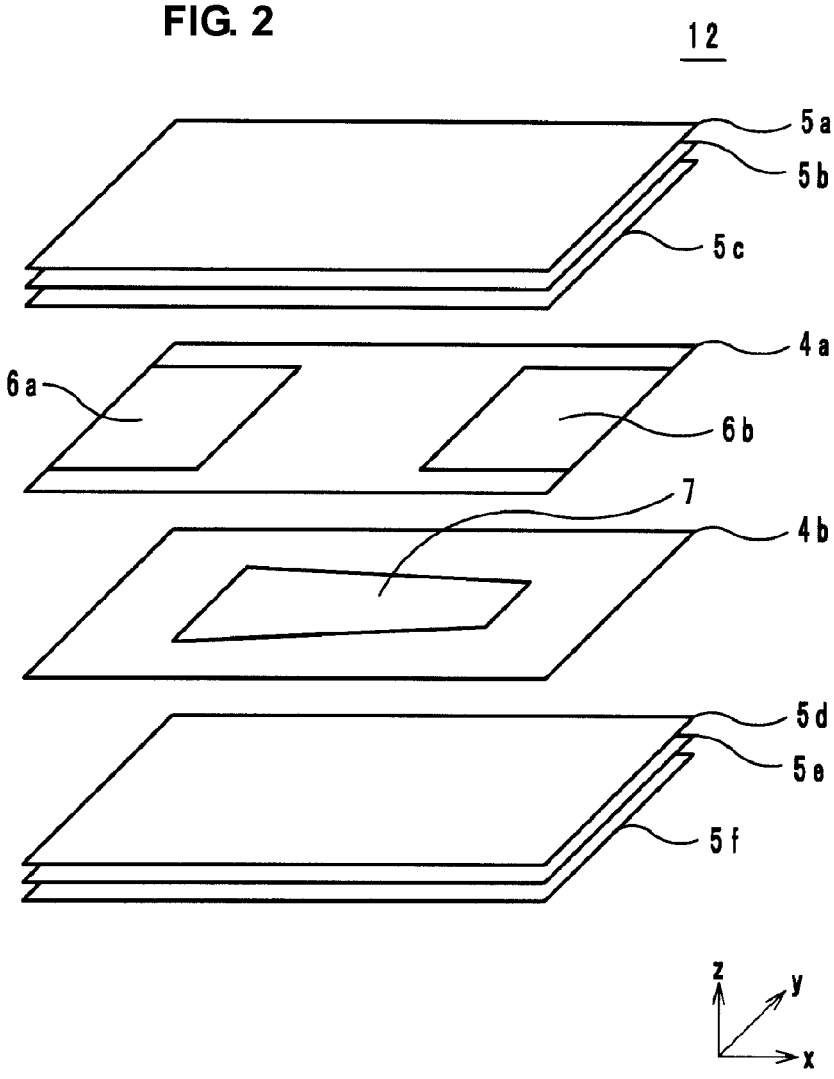
FIG. 2 is an exploded perspective view of a layered structure of the electronic component illustrated in FIG. 1.
Figure 3A:
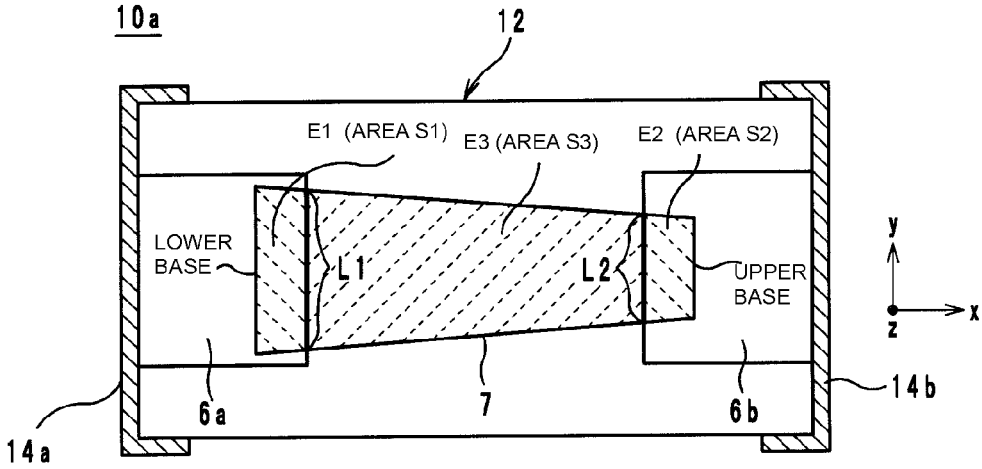
FIG. 3A illustrates the electronic component shown in FIG. 1 viewed in plan from a z-axis direction.
Figure 3B:
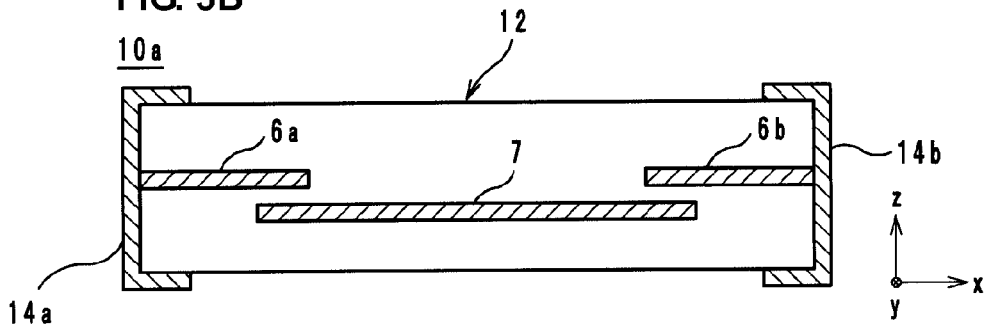
FIG. 3B is a cross-sectional view of the electronic component illustrated in FIG. 1 in an xy plane.

FIG. 1 is an external perspective view of an electronic component 10*a* according to a preferred embodiment of the present invention. FIG. 2 is an exploded view of a layered structure 12 of the electronic component 10*a*. In the following description, the direction in which ceramic green sheets are laminated in the process of forming the electronic component 10*a* is defined as the lamination direction. That lamination direction indicates a z-axis direction; the substantially longitudinal direction of the electronic component 10*a* indicates an x-axis direction; and a direction substantially perpendicular to the x-axis and z-axis indicates a y-axis direction. The x-axis, y-axis, and z-axis are substantially perpendicular to a corresponding side of the electronic component 10*a*. FIG. 3A illustrates the electronic component 10*a* viewed in plan from the z-axis direction. FIG. 3B is a cross-sectional view of the electronic component 10*a* in an xy plane.

As illustrated in FIG. 1, the electronic component 10*a* includes a substantially rectangular parallelepiped layered structure 12 and external electrodes 14*a* and 14*b* disposed on the surface of the layered structure 12. The layered structure 12 includes a thermistor. The external electrodes 14*a* and 14*b* are arranged so as to cover respective side surfaces of the layered structure 12 at opposite ends in the x-axis direction.

The layered structure 12 includes a plurality of internal electrodes and ceramic layers laminated together. More specifically, the layered structure 12 is formed by laminating a plurality of ceramic layers 5*a*, 5*b*, 5*c*, 4*a*, 4*b*, 5*d*, 5*e*, and 5*f* in that order, as illustrated in FIG. 2. The plurality of ceramic layers 5*a* to 5*c*, 4*a*, 4*b*, and 5*d* to 5*f* are substantially rectangular semiconductor layers having substantially the same area and shape.

As illustrated in FIG. 2, a substantially rectangular internal electrode 6*a* is disposed on a principal surface of the ceramic layer 4*a*. The internal electrode 6*a* extends substantially from a short side of the ceramic layer 4*a* disposed in the negative x-axis direction to the positive x-axis direction. The internal electrode 6*a* is connected to the external electrode 14*a* at the short side disposed in the negative x-axis direction, as illustrated in FIGS. 3A and 3B.

As illustrated in FIG. 2, a substantially rectangular internal electrode 6*b* is disposed on the principal surface of the ceramic layer 4*a*. The internal electrode 6*b* extends substantially from a short side of the ceramic layer 4*a* disposed in the positive x-axis direction to the negative x-axis direction. The internal electrode 6*b* is connected to the external electrode 14*b* at the short side disposed in the positive x-axis direction, as illustrated in FIGS. 3A and 3B.

As illustrated in FIGS. 2, 3A, and 3B, the internal electrodes 6*a* and 6*b* have substantially the same width in the y-axis direction. The internal electrodes 6*a* and 6*b* are aligned or substantially aligned along the x-axis direction and are separated by a predetermined gap.

As illustrated in FIGS. 2, 3A, and 3B, a substantially isosceles trapezoidal internal electrode 7 (isolated electrode) is disposed on a principal surface of the ceramic layer 4*b*. The internal electrode 7 extends in the x-axis direction and is not connected to the external electrodes 14*a* and 14*b*. More specifically, as illustrated in FIG. 3A, the width of the internal electrode 7 in the y-axis direction decreases in the direction from a side on an end in the negative x-axis direction (hereinafter referred to as the lower base) to another side on an end in the positive x-axis direction (hereinafter referred to as the upper base). The height direction of the substantially isosceles trapezoidal internal electrode 7 is substantially the same as the x-axis direction.

As illustrated in FIG. 3A, when viewed in plan from the z-axis direction, the internal electrode 6*a* faces the lower base of the internal electrode 7 such that the ceramic layer 4*a* is disposed therebetween. Similarly, the internal electrode 6*b* faces the upper base of the internal electrode 7 such that the ceramic layer 4*a* is disposed therebetween. The ceramic layer 4*a* and the internal electrodes 7, 6*a*, and 6*b* define the thermistor.

The ceramic layers 5*a* to 5*c*, 4*a*, 4*b*, and 5*d* to 5*f* illustrated in the exploded perspective view of FIG. 2 are laminated in that order from top to bottom in the z-axis direction to define the layered structure 12. The external electrodes 14*a* and 14*b* are provided on the surface of the layered structure 12. In this manner, the electronic component 10*a* is obtained.

The electronic component 10*a* allows the resistance value to be both increased and reduced without changing the design of the internal electrode 7, for example the size or shape, thus enabling fine adjustment of the resistance value, as described below with reference to FIGS. 3A to 5. More specifically, the resistance value can be increased by moving the internal electrode 7 in the positive x-axis direction and can be decreased by moving the internal electrode 7 in the negative x-axis direction. That is, for the electronic component 10*a*, the resistance value of the electronic component 10*a* illustrated in FIGS. 3A and 3B can be increased and decreased, thus enabling the electronic component to have various resistance values. Fine adjustment of the resistance value of the electronic component 10*a* can be performed without having to change the design of the internal electrode 7, for example, the size or shape.

Figure 4A:
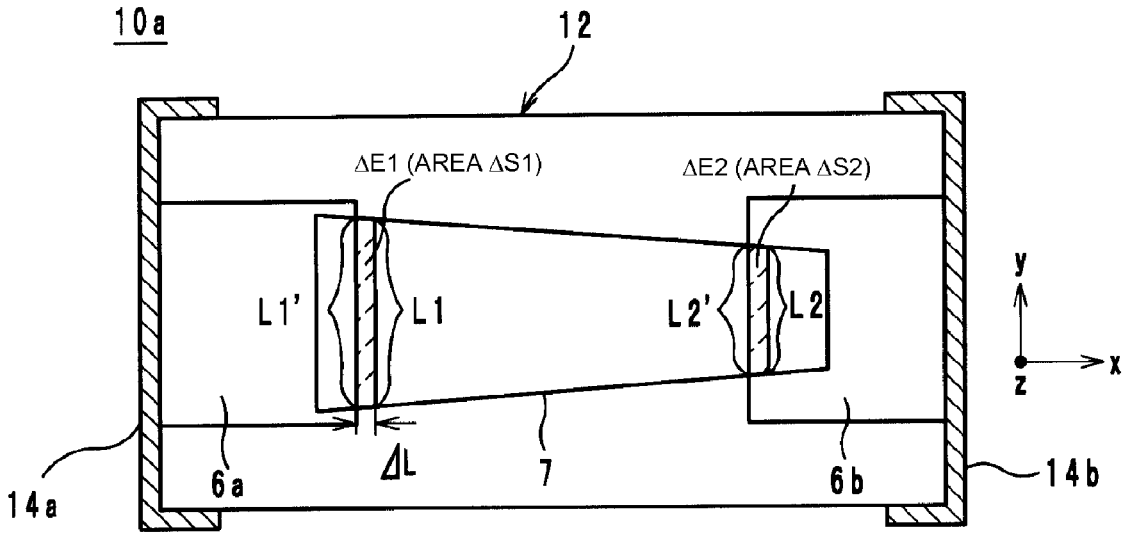
FIG. 4A illustrates the electronic component viewed in plan from the z-axis direction when an internal electrode is moved by ΔL in a positive x-axis direction from the state shown in FIGS. 3A and 3B.
Figure 4B:
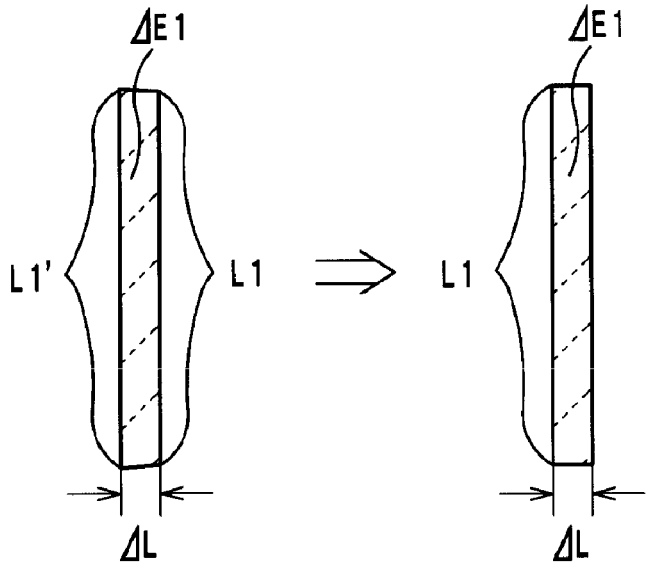
FIG. 4B illustrates the amount of decrease of the area of a portion where internal electrodes overlap each other.
Figure 4C:
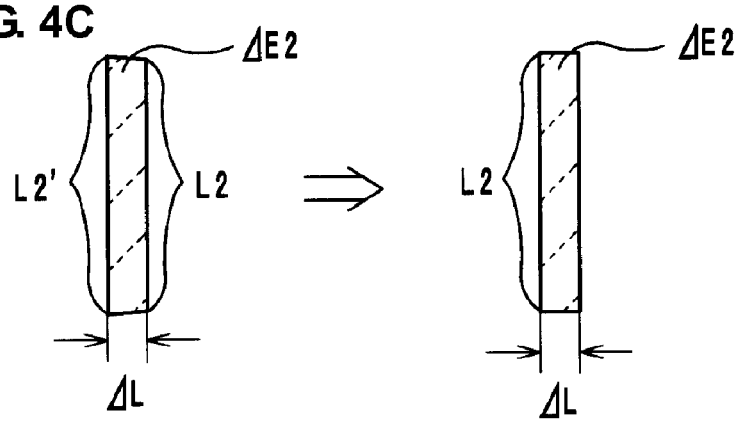
FIG. 4C illustrates the amount of increase of the area of a portion where internal electrodes overlap each other.
Figure 5A:
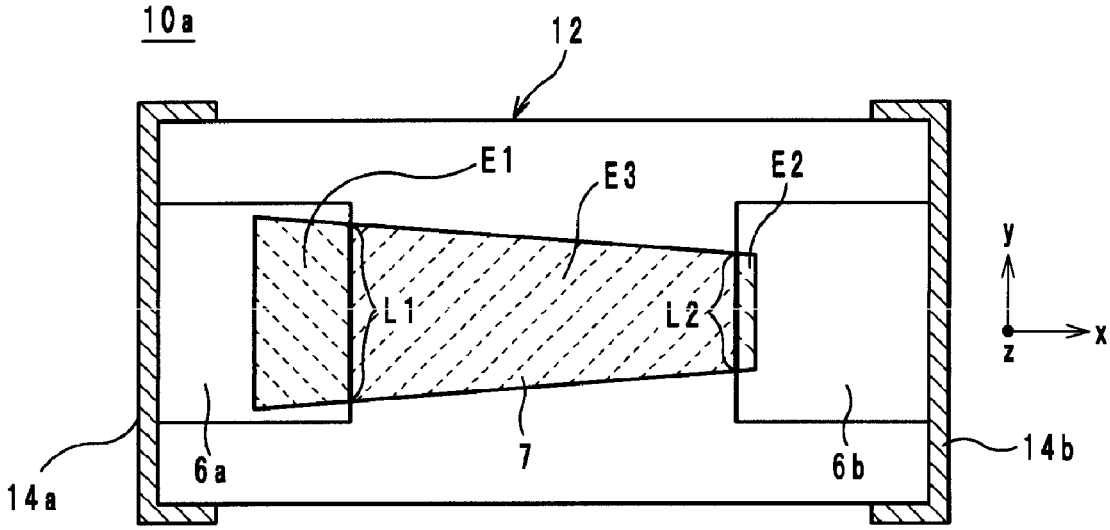
FIG. 5A illustrates the electronic component viewed in plan from the z-axis direction when the internal electrode is moved by ΔL in a negative x-axis direction from the state shown in FIGS. 3A and 3B.
Figure 5B:
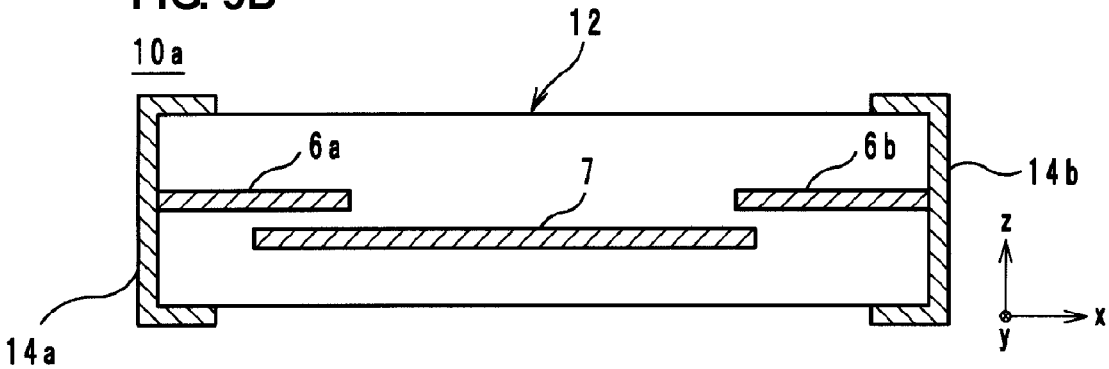
FIG. 5B is a cross-sectional view of the electronic component illustrated in FIG. 5A.

FIG. 4A illustrates the electronic component 10*a* viewed in plan from the z-axis direction when the internal electrode 7 is moved by ΔL in the positive x-axis direction from the state shown in FIGS. 3A and 3B. FIG. 4B illustrates the amount of decrease in the area of a portion where the internal electrode 6*a* and the internal electrode 7 overlap each other. FIG. 4C illustrates the amount of increase in the area of a portion where the internal electrode 6*b* and the internal electrode 7 overlap each other. FIG. 5A illustrates the electronic component 10*a* viewed in plan from the z-axis direction when the internal electrode 7 is moved by ΔL in the negative x-axis direction from the state illustrated in FIGS. 3A and 3B. FIG. 5B is a cross-sectional view of the electronic component 10*a* illustrated in FIG. 5A in an xy plane.

In FIG. 3A, a region E1 indicates a region of the internal electrode 7 that overlaps the internal electrode 6*a*, a region E2 indicates a region of the internal electrode 7 that overlaps the internal electrode 6*b*, and a region E3 indicates a region of the internal electrode 7 that does not overlap either of the internal electrodes 6*a* and 6*b*. The region E1 has an area S1, the region E2 has an area S2, and the region E3 has an area S3.

As illustrated in FIG. 3A, in the electronic component 10*a*, the internal electrode 6*a* has a width in the y-axis direction that is slightly greater than the width of the lower base of the internal electrode 7 in the y-axis direction. The internal electrode 6*b* has a width in the y-axis direction that is greater than the width of the upper base of the internal electrode 7 in the y-axis direction. When a portion of the lower base of the substantially isosceles trapezoidal internal electrode 7 overlaps the internal electrode 6*a* and a portion of the upper base thereof overlaps the internal electrode 6*b*, a width L1 in the y-axis direction between the opposite ends of a portion of the region E3 that is in contact with the internal electrode 6*a* in plan view is greater than a width L2 in the y-axis direction between the opposite ends of a portion of the region E3 that is in contact with the internal electrode 6*b* in plan view.

When the width L1 is greater than the width L2, as described above, the amount of increase and decrease in the area S1 of the region E1 is greater than that in the area S2 of the region E2 when the internal electrode 7 is moved in the x-axis direction. That is, the area S3 of the region E3 can be increased and decreased merely by moving the internal electrode 7 without changing the shape of the internal electrode 6*a*, 6*b*, or 7. The details are described below.

When the internal electrode 7 is moved by ΔL in the positive x-axis direction, as illustrated in FIGS. 4A and 4B, the area S1 of the region E1 is reduced by the area ΔS1 corresponding to a substantially isosceles trapezoidal region ΔE1. Here, the amount of movement of the internal electrode 7 to adjust the resistance value is preferably about 0.05 mm or less, for example. Accordingly, the region ΔE1 can preferably be approximated to a rectangle having the length L1 and the width ΔL, as illustrated in FIG. 4B. Similarly, the area S2 of the region E2 is increased by the area ΔS2 corresponding to a substantially isosceles trapezoidal region ΔE2. Accordingly, the region ΔE2 can preferably be approximated to a rectangle having the length L2 and the width ΔL, as illustrated in FIG. 4C.

When the area ΔS1 of the region ΔE1 and the area ΔS2 of the region ΔE2 are compared with each other, because the width L1 is greater than the width L2, the area ΔS1 is greater than the area ΔS2. That is, in the electronic component 10*a*, the sum of the areas of the overlapping portions where the internal electrodes 6*a* and 6*b* overlap the internal electrode 7, i.e., the sum of the area S1 of the region E1 and the area S2 of the region E2 can be reduced by moving the internal electrode 7 in the positive x-axis direction. The resistance value of the electronic component 10*a* depends on the sum of the areas S1 and S2. When the sum of the areas S1 and S2 is reduced by moving the internal electrode 7 in the positive x-axis direction, the resistance value of the electronic component 10*a* is increased.

In contrast, as illustrated in FIGS. 5A and 5B, when the internal electrode 7 is moved in the negative x-axis direction, the sum of the areas S1 and S2 is increased and the resistance value of the electronic component 10*a* is reduced. The principle of this is substantially the same as that in the movement of the internal electrode 7 in the positive x-axis direction described above, so the description thereof is not repeated herein.

As explained above, the internal electrodes 6*a*, 6*b*, and 7 in the electronic component 10*a* have a structure and arrangement in which the width L1 is greater than the width L2. Accordingly, the resistance value of the electronic component 10*a* can be decreased or increased by moving the internal electrode 7 in the positive x-axis direction or the negative x-axis direction. As a result, fine adjustment of the resistance value can be performed without having to change the design of the internal electrode 7, for example, the size or shape.

Additionally, in the electronic component 10*a*, the width of the internal electrode 7 in the y-axis direction decreases in the positive x-axis direction, as illustrated in FIG. 3A. Thus, irrespective of the amount of movement of the internal electrode 7, the width L1 is always greater than the width L2. Accordingly, in the electronic component 10*a*, an increase in the amount of movement of the internal electrode 7 enables an increase in the range of adjustment of the resistance value.

Furthermore, in the electronic component 10*a*, as illustrated in FIG. 3A, each of the width of the internal electrode 6*a* in the y-axis direction and the width of the internal electrode 6*b* in the y-axis direction is greater than each of the length of the lower base of the internal electrode 7 and the length of the upper base of the internal electrode 7. Accordingly, even if the internal electrode 7 is displaced due to misregistration during lamination of the ceramic green sheets in the process of forming the layered structure 12 of the electronic component 10*a*, the internal electrode 7 is not likely to extend from the edges of the internal electrodes 6*a*, 6*b*, and 7 in the y-axis direction. As a result, deviations of the resistance value of the electronic component 10*a* are prevented.

In some cases, depending on conditions, such as temperature and humidity, because of print blurring or light printing that may occur in the process of printing an internal electrode on a ceramic layer, an electronic component having a desired resistance value may not be able to be obtained. To address this problem, with the aim to finely adjust the resistance value to a desired resistance value, the internal electrode 7 may be moved in the x-axis direction.

Figure 6A:
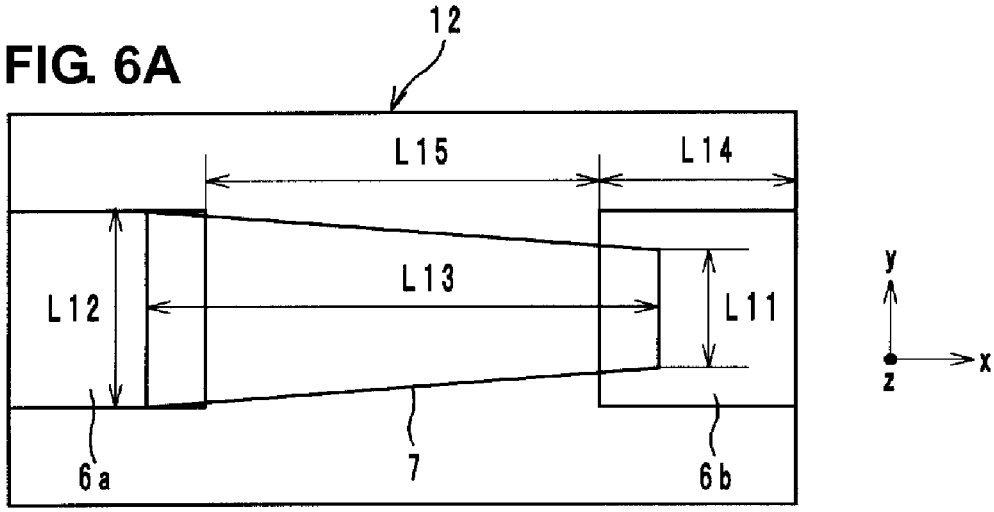
FIG. 6A illustrates a first model corresponding to the electronic component shown in FIG. 1 viewed in plan from the z-axis direction.
Figure 6B:
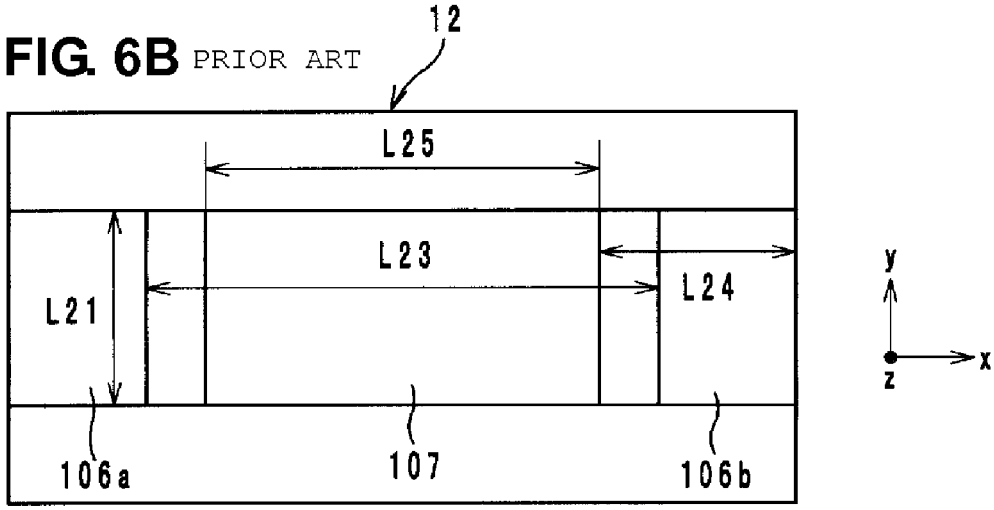
FIG. 6B PRIOR ART
FIG. 6B illustrates a second model corresponding to a laminated thermistor described in Japanese Unexamined Patent Application Publication No. 5-243007 viewed in plan from the z-axis direction.
Figure 6C:
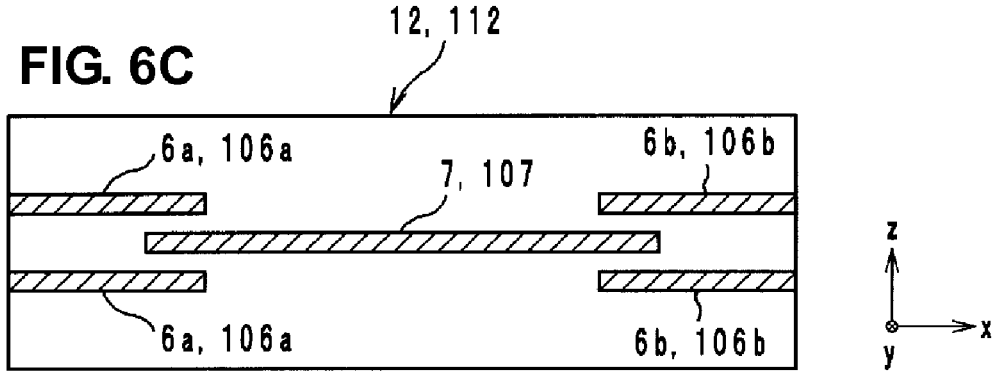
FIG. 6C is a cross-sectional view of the first and second models in an xy plane.

The inventor of the present invention performed a simulation described below to clarify advantages that are obtained by the electronic component 10*a*. FIGS. 6A to 6C illustrate models used in the simulation. FIG. 6A illustrates a first model corresponding to the electronic component 10*a* according to a preferred embodiment of the present invention viewed in plan from the z-axis direction. FIG. 6B illustrates a second model corresponding to the laminated thermistor described in Japanese Unexamined Patent Application Publication No. 5-243007 viewed in plan from the z-axis direction. FIG. 6C is a cross-sectional view of the first and second models in an xy plane. In this simulation, the internal electrodes 6*a*, 6*b*, 7, 106*a*, 106*b*, and 107 of the two models illustrated in FIGS. 6A and 6B were moved in the x-axis direction, and the resistance values of the electronic component 10*a* and the laminated thermistor 110 were calculated. The conditions of the simulation are described below.

In the first model illustrated in FIG. 6A, the model of 0603 chip size (approximately 0.6 mm×0.3 mm×0.3 mm) is used, and the internal electrodes 6*a*, 6*b*, and 7 are arranged in a similar manner to the electronic component 10*a* illustrated in FIGS. 3A and 3B. In contrast to the electronic component 10*a*, the two internal electrodes 6*a* and the two internal electrodes 6*b* are provided, and the internal electrode 7 is sandwiched between the two internal electrodes 6*a* and between the two internal electrodes 6*b*. The length L11 of the upper base of the internal electrode 7 is approximately 0.16 mm, the length L12 of the lower base thereof is approximately 0.2 mm, and the height L13 thereof is approximately 0.405 mm. The width L12 of each of the internal electrodes 6*a* and 6*b* is approximately 0.2 mm. The gap between the internal electrodes 6*a* and 6*b* is indicated by L15.

Figure 10A:
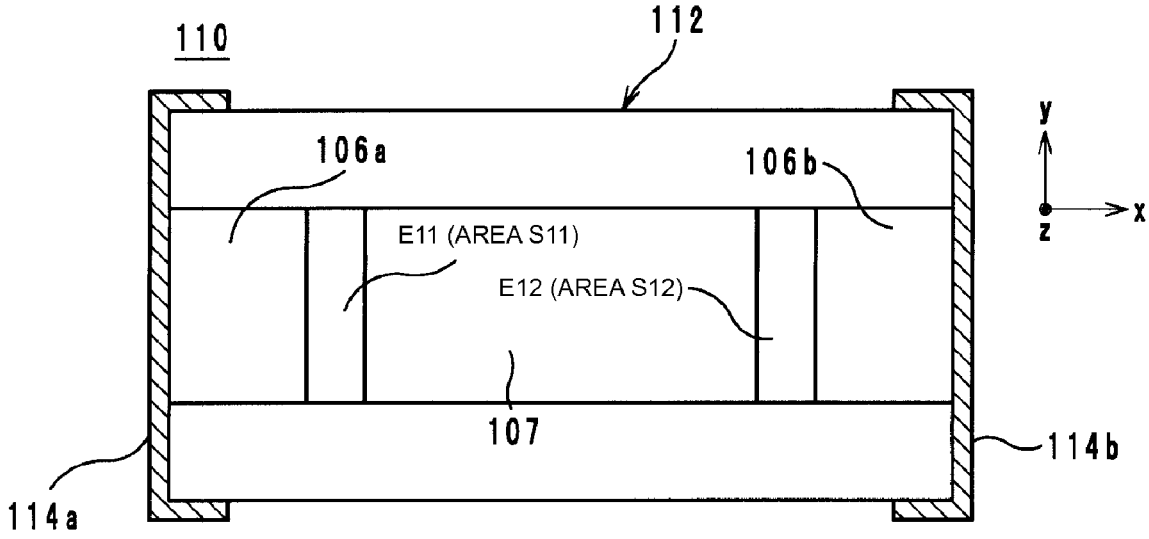
FIG. 10A PRIOR ART
FIGS. 10A and 10B illustrate the laminated thermistor described in Japanese Unexamined Patent Application Publication No. 5-243007.
Figure 10B:
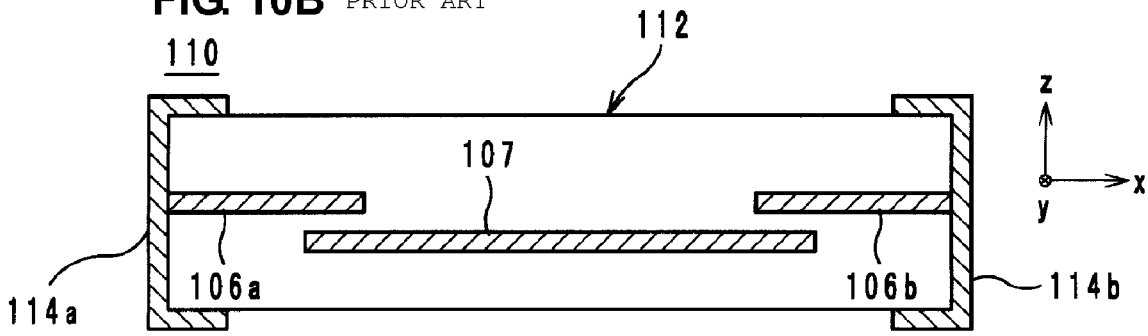
FIG. 10B PRIOR ART

In the second model illustrated in FIG. 6B, the model of 0603 chip size (approximately 0.6 mm×0.3 mm×0.3 mm) is used, and the internal electrodes 106*a*, 106*b*, and 107 are arranged in a similar manner to the laminated thermistor 110 illustrated in FIGS. 10A and 10B. In contrast to the laminated thermistor 110, the two internal electrodes 106*a* and the two internal electrodes 106*b* are provided, and the internal electrode 107 is sandwiched between the two internal electrodes 106*a* and between the two internal electrodes 106*b*. The width L21 of the internal electrode 107 is approximately 0.2 mm, and the height L23 thereof is approximately 0.38 mm. The width L21 of each of the internal electrodes 106*a* and 106*b* is approximately 0.2 mm. The gap between the internal electrodes 106*a* and 106*b* is indicated by L25.

Figure 7:
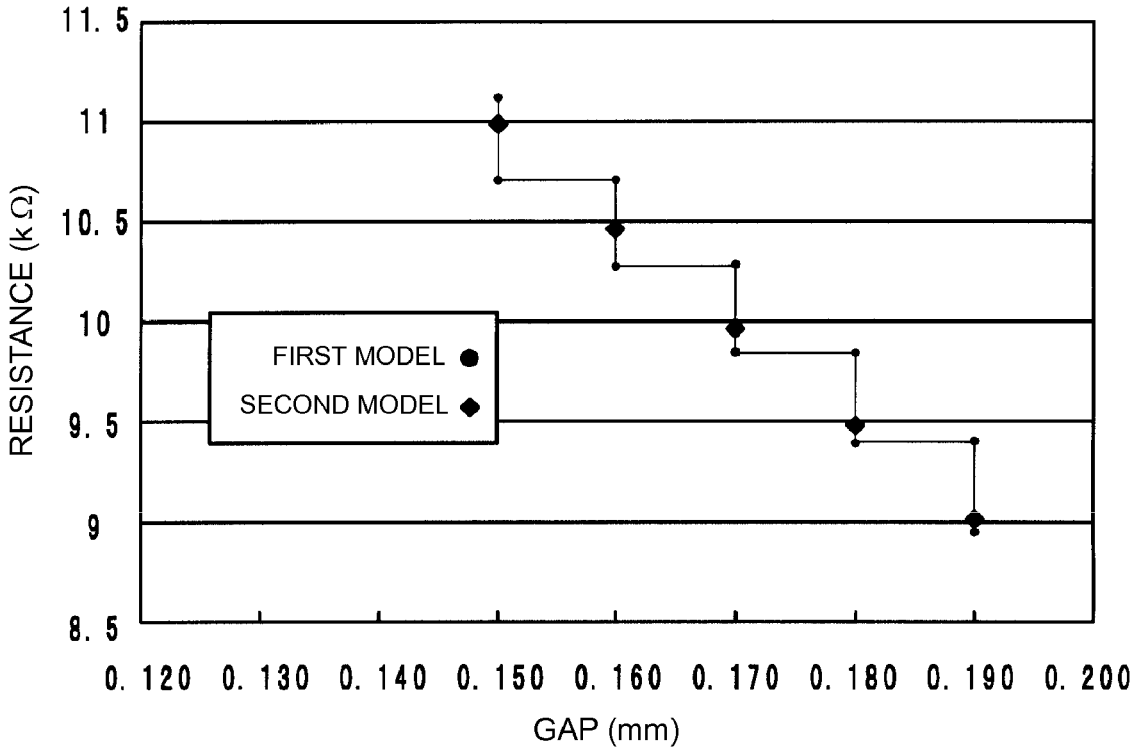
FIG. 7 is a graph that illustrates results of a simulation.

Under the above-described simulation conditions, the resistance values were calculated when the internal electrodes 7 and 107 were displaced by approximately ±0.05 mm in the x-axis direction from the respective reference positions. Here, the reference position for the internal electrode 7 is the position of the internal electrode 7 when the overlap portion between the internal electrodes 7 and 6*a* and the overlap portion between the internal electrodes 7 and 6*b* have substantially the same width in the x-axis direction. Similarly, the reference position for the internal electrode 107 indicates the position thereof when the overlap portion between the internal electrodes 107 and 106*a* and the overlap portion between the internal electrodes 107 and 106*b* have substantially the same width in the x-axis direction. The resistance values were calculated when the gaps L15 and L25 were changed in units of approximately 0.01 mm between approximately 0.15 mm and approximately 0.19 mm. FIG. 7 is a graph that illustrates the results of the simulation. The vertical axis indicates the values of resistance, and the horizontal axis indicates the magnitudes of the gaps.

As illustrated in FIG. 7, in the second model corresponding to the laminated thermistor described in Japanese Unexamined Patent Application Publication No. 5-243007, when the gap L25 is approximately 0.15 mm, the resistance value is approximately 11 kΩ, for example, and even if the internal electrode 107 is moved, the resistance value remains substantially the same. In contrast, in the first model corresponding to the electronic component 10*a*, when the gap L15 is approximately 0.15 mm, the resistance value is changed from approximately 10.7 kΩ to approximately 11.2 kΩ if the internal electrode 7 is moved. Thus, it is understood that a change of approximately 0.4 kΩ to approximately 0.5 kΩ is obtainable merely by moving the internal electrode 7. That is, the simulation shows that the resistance value in the laminated thermistor described in Japanese Unexamined Patent Application Publication No. 5-243007 cannot be changed by moving the internal electrode 107, whereas the resistance value in the electronic component 10*a* according to a preferred embodiment of the present invention can be changed by moving the internal electrode 7. In addition, minute changes in the resistance value can be made. Accordingly, the use of the electronic components 10*a* enables an electronic component to have various resistance values without changing the design thereof.

As illustrated in FIG. 7, in the second model, even when the gap L25 is fixed at approximately 0.150 mm and the internal electrode 107 is moved, the resistance value is approximately 11 kΩ and remains substantially unchanged. Also, even when the gap L25 is incrementally changed by approximately 0.01 mm, the resistance value can only be discontinuously changed in units of approximately 0.4 kΩ to approximately 0.5 kΩ. In contrast, in the first model according to a preferred embodiment of the present invention, as illustrated in FIG. 7, when the gap L15 is increased by approximately 0.01 mm, the resistance value is reduced by approximately 0.4 kΩ to approximately 0.5 kΩ. In addition, when the gap L15 is fixed and the internal electrode 7 is moved by approximately 0.05 mm, the resistance value is changed by approximately 0.4 kΩ to approximately 0.5 kΩ. That is, in the first model according to a preferred embodiment of the present invention, the resistance value can be continuously changed in the range of approximately 8.9 kΩ to approximately 11.2 kΩ by adjusting the gap L15 in units of approximately 0.01 mm and the movement of the internal electrode 7 in units of approximately 0.05 mm. In other words, in the electronic component 10*a*, the resistance value can be more finely adjusted over a wider range. Accordingly, in the electronic component 10*a*, a small amount of displacement of the resistance value resulting from print blurring or light printing of the internal electrodes 6*a*, 6*b*, and 7 can be corrected by adjusting the amount of movement of the internal electrode 7 and the magnitude of the gap L15.

As is clear from FIGS. 3A, 3B, and 4A to 4C, the resistance value of the electronic component 10*a* can be decreased or increased by moving the internal electrode 7 in the positive or negative x-axis direction because the internal electrode 7 preferably has a substantially isosceles trapezoidal shape. However, even when the internal electrode 7 has a shape other than a substantially isosceles trapezoid shape, the resistance value of the electronic component can be decreased or increased using any suitable structure and arrangement in which the width L1 is greater than the width L2 in the internal electrodes 6*a*, 6*b*, and 7. Modified examples of the electronic component 10*a* are described below with reference to the drawings. FIGS. 8A to 8C and 9A and 9B illustrate electronic components 10*b* to 10*f* according to the modified examples of preferred embodiments of the present invention viewed in plan from the z-axis direction.

Figure 8A:
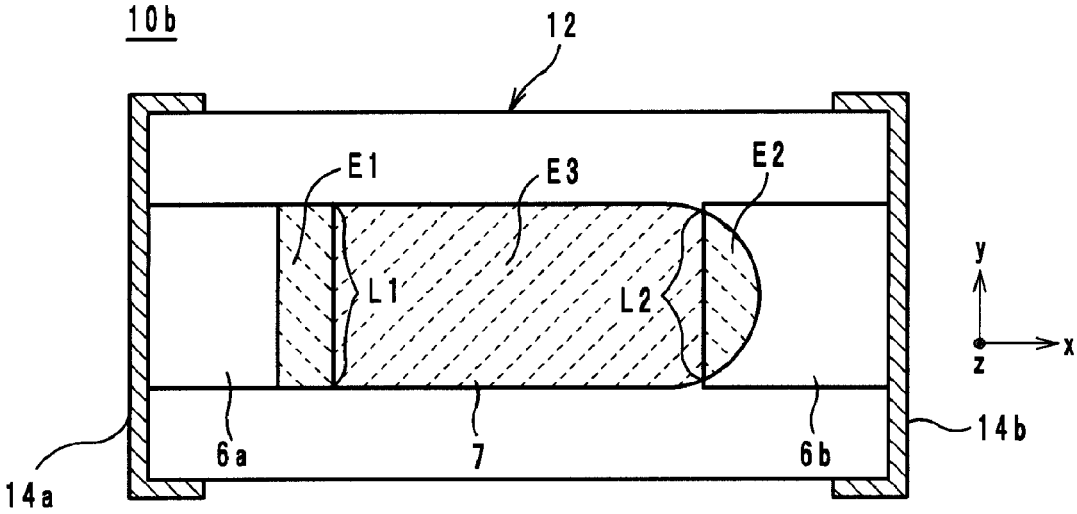
FIGS. 8A to 8C illustrate electronic components according to modified examples of preferred embodiments of the present invention viewed in plan from the z-axis direction.

FIG. 8A illustrates the electronic component 10*b* according to a first modified example viewed in plan from the z-axis direction. The internal electrode 7 included in the electronic component 10*b* has the shape of a combination of a substantial rectangle and a substantial semicircle. More specifically, the internal electrode 7 has a shape in which the substantially semicircular electrode is coupled to a portion of the substantially rectangular electrode in the positive x-axis direction. Even in the electronic component 10*b* including the internal electrode 7 having this a shape, the width L1 is greater than the width L2. As a result, the resistance value of the electronic component 10*b* can be decreased or increased by moving the internal electrode 7 in the positive or negative x-axis direction.

Figure 8B:
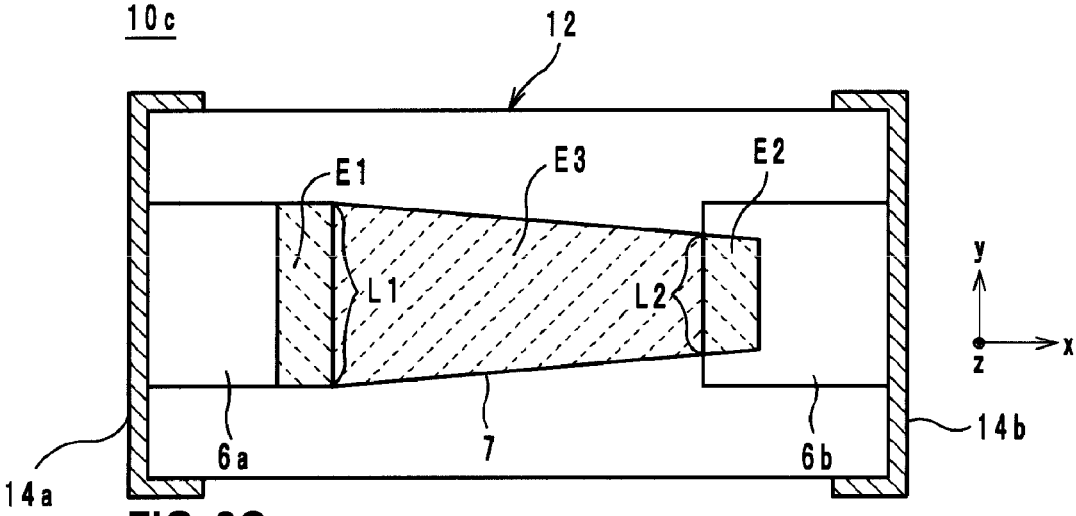

FIG. 8B illustrates the electronic component 10*c* according to a second modified example viewed in plan from the z-axis direction. The internal electrode 7 included in the electronic component 10*c* has the shape of a combination of a substantial isosceles trapezoid and a substantial rectangle. More specifically, the internal electrode 7 has a shape in which the substantially rectangular electrode is coupled to a portion of the substantially isosceles trapezoidal electrode in the negative x-axis direction. Even in the electronic component 10*c* including the internal electrode 7 having this shape, the width L1 is greater than the width L2. As a result, the resistance value of the electronic component 10*c* can be decreased or increased by moving the internal electrode 7 in the positive or negative x-axis direction.

In the above-described electronic components 10*a* to 10*c*, in order for the width L1 to be greater than the width L2, the width of the internal electrode 7 in the y-axis direction is reduced in the positive x-axis direction. However, this is not the only way to have the width L1 greater than the width L2. Other ways are described below using other modified examples of preferred embodiments of the present invention.

Figure 8C:
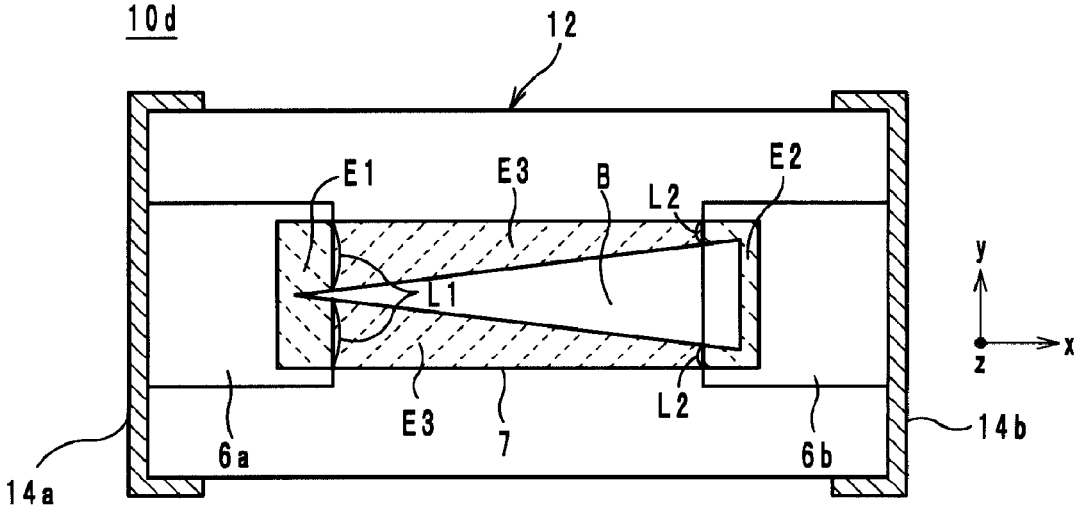

FIG. 8C illustrates the electronic component 10*d* according to a third modified example viewed in plan from the z-axis direction. The internal electrode 7 included in the electronic component 10*d* has a substantially rectangular outer shape. It is noted that the internal electrode 7 has a substantially triangular space B that does not include a conductive film therein. The space B has a shape in which the width thereof in the y-axis direction increases in the direction from the edge at which the internal electrode 7 and the internal electrode 6*a* overlap each other to the edge at which the internal electrode 7 and the internal electrode 6*b* overlap each other.

In the electronic component 10*d*, as illustrated in FIG. 8C, each of the widths L1 and L2 is defined as the width of the space B in the y-axis direction subtracted from the width of the internal electrode 7 in the y-axis direction. The width of the internal electrode 7 in the y-axis direction is constant or substantially constant in the x-axis direction, whereas the width of the space B in the y-axis direction increases in the positive x-axis direction. Accordingly, in the electronic component 10*d*, the width L1 is greater than the width L2. As a result, the resistance value of the electronic component 10*d* can be decreased or increased by the movement of the internal electrode 7 in the positive or negative x-axis direction. In addition, because the outer shape of the internal electrode 7 in the electronic component 10*d* is substantially rectangular, deviations in the resistance value of the electronic component 10*d* can be prevented. In the electronic component 10*d*, the space B may preferably be substantially trapezoidal, for example.

Figure 9A:
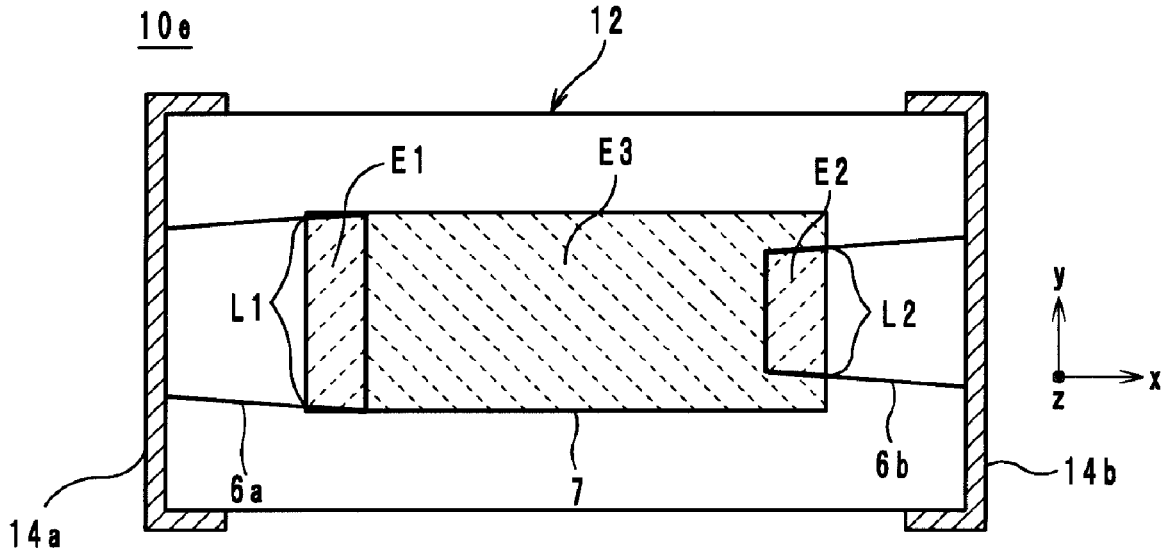
FIGS. 9A and 9B illustrate electronic components according to other modified example of preferred embodiments viewed in plan from the z-axis direction.

FIG. 9A illustrates the electronic component 10*e* according to a fourth modified example viewed in plan from the z-axis direction. The internal electrode 7 included in the electronic component 10*e* preferably has a substantially rectangular shape, and each of the internal electrodes 6*a* and 6*b* preferably has a substantially isosceles trapezoidal shape. More specifically, the width of each of the internal electrodes 6*a* and 6*b* in the y-axis direction increases in the positive x-axis direction. In addition, the width of the internal electrode 6*a* in the y-axis direction is equal or substantially equal to (in FIG. 9A) or greater than the width of the internal electrode 7 in the y-axis direction at the end in the negative x-axis direction (the width of the internal electrode 7 in the y-axis direction shown in FIG. 9A, where the internal electrode 7 is substantially rectangular). With the use of the internal electrodes 6*a*, 6*b*, and 7 having such a structure, the width L1 can be greater than the width L2. As a result, the resistance value of the electronic component 10*e* can be decreased or increased by the movement of the internal electrode 7 in the positive or negative x-axis direction.

Figure 9B:
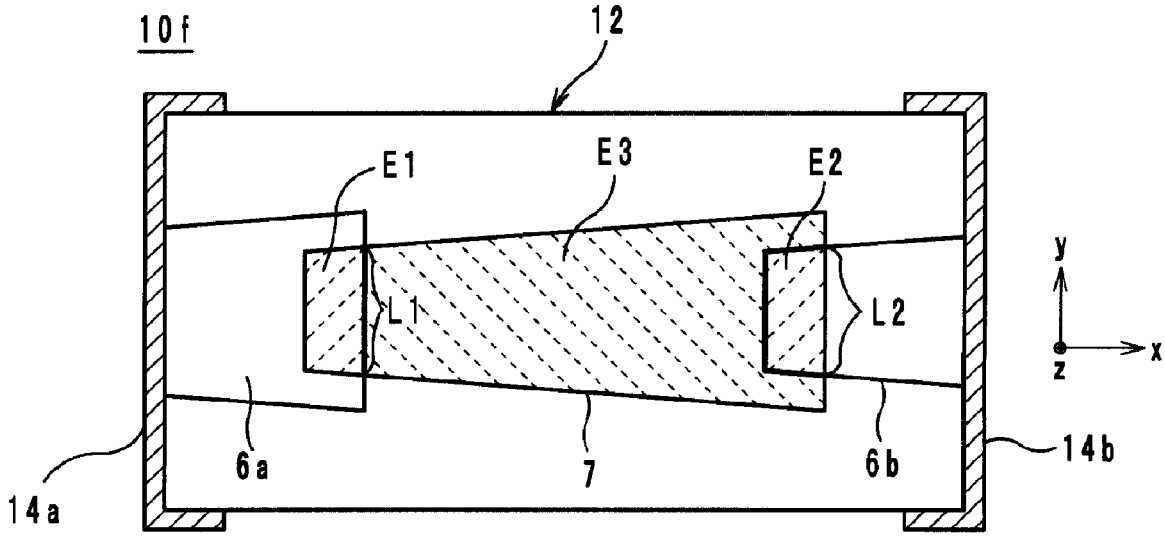

FIG. 9B illustrates the electronic component 10*f* according to a fifth modified example viewed in plan from the z-axis direction. The internal electrode 7 included in the electronic component 10*f* preferably has a substantially isosceles trapezoidal shape, similar to the internal electrode 7 of the electronic component 10*a* illustrated in FIG. 3A. Each of the internal electrodes 6*a* and 6*b* included in electronic component 10*f* preferably has a substantially isosceles trapezoidal shape, similar to those of the electronic component 10*e* illustrated in FIG. 9A. More specifically, the width of each of the internal electrodes 6*a*, 6*b*, and 7 in the y-axis direction increases in the positive x-axis direction. In addition, the width of the internal electrode 6*a* in the y-axis direction at the edge in the positive x-axis direction is greater than the width of the internal electrode 7 in the y-axis direction at the edge in the negative x-axis direction. Additionally, the width of the internal electrode 6*b* in the y-axis direction at the edge in the negative x-axis direction is greater than the width of the internal electrode 7 in the y-axis direction at the edge in the positive x-axis direction. With the use of the internal electrodes 6*a*, 6*b*, and 7 having such a structure, the width L1 can preferably be greater than the width L2. As a result, the resistance value of the electronic component 10*f* can be decreased or increased by the movement of the internal electrode 7 in the positive or negative x-axis direction. In particular, this modified example is advantageous in terms of efficiency of mass production because substantially the same electrode pattern can be used in the internal electrodes 6*a*, 6*b*, and 7.

In the electronic components 10*a* to 10*f*, it is preferable that the width L1 is always greater than the width L2 even when the internal electrode 7 is moved in the x-axis direction. It is noted that the amount of movement of the internal electrode 7 to adjust the resistance value is relatively small in many cases. Accordingly, the width L1 need only be greater than the width L2 at least within the range at which the internal electrode 7 is moved to adjust the resistance value, so the width L2 may be greater than the width L1 in other ranges. The range of the amount of movement of the internal electrode 7 to adjust the resistance value may preferably be, for example, approximately 0.05 mm.

The electronic components 10*a* to 10*f* according to the various preferred embodiments and modified examples of the present invention are illustrated by way of example. The present invention is not limited to these above-described preferred embodiments and examples. For example, the internal electrodes 6*a* and 6*b* may preferably be disposed on different planes. One example of this is that the internal electrodes 6*a* and 6*b* are disposed on first and second planes, respectively, that face and sandwich the isolated electrode 7.

A method of manufacturing the electronic components 10*a* to 10*f* according to a preferred embodiment of the present invention is described below with reference to FIGS. 1 and 2. Here, a method of manufacturing the electronic component 10*a* is described as one example of the method of manufacturing the electronic components 10*a* to 10*f*.

First, a material including approximately 78.5 mol % $Mn_3O_4$, approximately 21.5 mol % NiO, and, when these materials are 100 molar portions, approximately 0.5 molar portion of $TiO_2$ are prepared. Then, pure water is added to compounded powder, the mixture is subjected to a mixing and crushing process together with a zirconia ball for approximately 10 hours. After being dried, the mixture is calcined at approximately 1100° C. for approximately two hours.

An organic binder, a disperser, and water are added to the obtained calcined powder and mixed together with a zirconia ball for several hours to produce slurry.

Then, a ceramic green sheet preferably having a thickness of approximately 20 μm to approximately 30 μm, for example, is formed using the slurry by the doctor blade technique, for example.

Then, conductive paste preferably including silver-palladium, for example, as a conductive component is printed by screen printing on ceramic green sheets defining the ceramic layers 4*a* and 4*b*, and conductive paste films defining the internal electrodes 6*a*, 6*b*, and 7 illustrated in FIG. 2 are formed.

Then, it is determined whether print blurring or light printing, for example, occurs in the conductive paste films defining the internal electrodes 6*a*, 6*b*, and 7. This may preferably be performed by, for example, the use of image analysis.

Then, ceramic green sheets defining ceramic layers 5*f*, 5*e*, 5*d*, 4*b*, 4*a*, 5*c*, 5*b*, and 5*a* are laminated from below in sequence and pressed and attached. Additionally, the laminated ceramic layers 5*f*, 5*e*, 5*d*, 4*b*, 4*a*, 5*c*, 5*b*, and 5*a* are cut into desired dimensions, and the green layered structure 12 is obtained. In the process of laminating the ceramic layer 4*a*, the ceramic green sheet defining the ceramic layer 4*a* is laminated while the position of the internal electrode 7 is adjusted such that the area S1 of the region E1, where the internal electrode 6*a* and the internal electrode 7 overlap each other, and the area S2 of the region E2, where the internal electrode 6*b* and the internal electrode 7 overlap each other, have desired areas. In particular, if print blurring occurs in the conductive paste, the areas S1 and S2 would be greater than the desired areas and the resistance value of the electronic component 10*a* would be less than a desired value. To avoid this deviation, the internal electrode 7 is moved in the positive x-axis direction when the ceramic green sheet defining the ceramic sheet 4*a* is laminated. If light printing occurs in the conductive paste, the areas S1 and S2 would be less than desired areas and the resistance value of the electronic component 10*a* would be greater than a desired value. To avoid this, the internal electrode 7 is moved in the negative x-axis direction when the ceramic green sheet defining the ceramic sheet 4*a* is laminated.

Then, the green layered structure 12 is degreased for approximately 20 hours at approximately 350° C. in the atmosphere, and is baked for approximately two hours at approximately 1200° C. in an air atmosphere. In such a manner, the baked layered structure 12 is obtained.

Then, by applying barrel polishing using silicon and aluminum polishing media, for example, to the layered structure 12, the corners of edges and edge lines are rounded.

Then, a silver baking electrode is preferably formed on a side surface of the layered structure 12. Subsequently, a nickel plating film is preferably formed on the silver electrode, and a tin plating film is preferably further formed to define the external electrodes 14*a* and 14*b*. Through the above-described steps, the electronic component 10*a* is completed.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An electronic component comprising:

a layered structure including laminated ceramic layers;

a first external electrode and a second external electrode disposed on a surface of the layered structure;

an isolated electrode extending in a predetermined direction inside the layered structure and not being connected to the first external electrode and the second external electrode;

a first internal electrode connected to the first external electrode, the first internal electrode facing a first end of the isolated electrode such that one of the ceramic layers is disposed therebetween; and a second internal electrode connected to the second external electrode, the second internal electrode facing a second end of the isolated electrode such that one of the ceramic layers is disposed therebetween; wherein when viewed in plan from a direction in which the ceramic layers are laminated, the isolated electrode includes a non-overlapping portion including a first section having a first width between opposite ends thereof and a second section having a second width between opposite ends thereof, and the first width is greater than the second width, the non-overlapping portion not overlapping the first internal electrode and the second internal electrode, the first section being in contact with at least one of the first internal electrode and the second internal electrode, the second section being in contact with the other one of the first internal electrode and the second internal electrode, the first width and the second width being perpendicular or substantially perpendicular to the predetermined direction.

2. The electronic component according to claim 1, wherein the first internal electrode and the isolated electrode overlap each other to define a first overlapping portion and the second internal electrode and the isolated electrode overlap each other to define a second overlapping portion, and an area of the first overlapping portion and an area of the second overlapping portion are dependent upon an amount by which the first width is greater than the second width.

3. The electronic component according to claim 1, wherein the isolated electrode has a width extending perpendicular or substantially perpendicular to the predetermined direction which decreases in a direction from the first end to the second end thereof; and each of the first internal electrode and the second internal electrode has a width arranged perpendicular or substantially perpendicular to the predetermined direction that is equal or substantially equal to or greater than each of the width of the isolated electrode at the first end and the width of the isolated electrode at the second end.

4. The electronic component according to claim 1, wherein the isolated electrode includes a space that has no conductive film therein; and the space has a width extending perpendicular or substantially perpendicular to the predetermined direction that increases in a direction from the first end to the second end of the isolated electrode.

5. The electronic component according to claim 1, wherein each of the isolated electrode, the first internal electrode, and the second internal electrode has a width extending perpendicular or substantially perpendicular to the predetermined direction that increases in a direction from the first end to the second end of the isolated electrode; and the isolated electrode, the first internal electrode, and the second internal electrode have substantially the same electrode pattern.

* * * * *